US009874091B2

(12) United States Patent
Thompson

(10) Patent No.: US 9,874,091 B2
(45) **Date of Patent: *Jan. 23, 2018**

(54) STRIPLINE ENERGY TRANSMISSION IN A WELLBORE

(71) Applicant: Chevron U.S.A. Inc., San Ramon, CA (US)

(72) Inventor: Melvin Clark Thompson, Los Alamos, NM (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/655,129

(22) Filed: Jul. 20, 2017

(65) Prior Publication Data

US 2017/0314390 A1 Nov. 2, 2017

Related U.S. Application Data

(63) Continuation-in-part of application No. 15/400,186, filed on Jan. 6, 2017, which is a continuation of application No. 14/955,763, filed on Dec. 1, 2015, now Pat. No. 9,540,923.

(60) Provisional application No. 62/088,219, filed on Dec. 5, 2014.

(51) Int. Cl.
*E21B 47/12* (2012.01)
*E21B 17/00* (2006.01)

(52) U.S. Cl.
CPC ..... *E21B 47/12* (2013.01); *E21B 17/003* (2013.01)

(58) Field of Classification Search
CPC ..... E21B 47/12; E21B 17/003
See application file for complete search history.

(56) References Cited

U.S. PATENT DOCUMENTS

| | | | | |
|---|---|---|---|---|
| 5,176,164 | A * | 1/1993 | Boyle | E21B 34/06 137/155 |
| 5,966,293 | A | 10/1999 | Obermaier | |
| 6,070,608 | A * | 6/2000 | Pringle | E21B 34/066 137/155 |
| 2003/0011442 | A1 | 1/2003 | Ashoka | |
| 2010/0175923 | A1 | 7/2010 | Allan | |
| 2010/0286800 | A1 | 11/2010 | Lerche | |
| 2013/0186641 | A1 | 7/2013 | Lovell | |
| 2013/0299237 | A1 | 11/2013 | Johnson | |

* cited by examiner

*Primary Examiner* — Nay Tun
(74) *Attorney, Agent, or Firm* — King & Spalding LLP

(57) ABSTRACT

A downhole energy transmission system is described. The system can include a tubing string having a number of tubing pipe disposed within an annulus formed by a casing string disposed within a wellbore, where the tubing string has at least one wall forming a cavity. The system can also include a remote electrical device disposed within the cavity of the tubing string at a first location. The system can further include a first stripline cable disposed on an outer surface of the tubing string, where the first stripline cable transmits a first electromagnetic directional traveling wave received from an energy source. The system can also include a second stripline cable disposed adjacent to the first stripline cable at the first location, where the second stripline cable is electrically coupled to the remote electrical device.

20 Claims, 11 Drawing Sheets

STRIPLINE ENERGY TRANSMISSION IN A WELLBORE

CROSS REFERENCE TO RELATED APPLICATIONS

This application is a continuation-in-part of and claims priority to U.S. patent application Ser. No. 15/400,186, titled "Stripline Energy Transmission in a Wellbore" and filed on Jan. 6, 2017, which is a continuation application of and claims priority under 35 U.S.C. § 120 to U.S. patent application Ser. No. 14/955,763, titled "Stripline Energy Transmission in a Wellbore" and filed on Dec. 1, 2015, which claims priority under 35 U.S.C. § 119 to U.S. Provisional Patent Application Ser. No. 62/088,219, titled "Stripline Energy Transmission in a Wellbore" and filed on Dec. 5, 2014. The entire contents of the foregoing applications are hereby incorporated herein by reference.

TECHNICAL FIELD

The present disclosure relates generally to energy transmission in a subterranean wellbore, and more specifically to energy transmission in a subterranean wellbore using stripline.

BACKGROUND

In the production of oil and gas from a wellbore, it is sometimes necessary to send power and/or control signals to electrical devices located within the wellbore. Without the power and/or control signals, these downhole electrical devices fail to operate. Such devices can include flow meters, pressure sensors, temperature sensors, and charges for fracturing operations. Subterranean wellbores may be drilled and constructed several miles below the ground or seabed. The electrical devices located in the wellbore are often in harsh environments. Traditional methods of delivering power to electrical devices within a wellbore are by using traditional electrical cable that is run between the casing and tubing string. Such cables sometimes are difficult and expensive to install and maintain in an operationally secure manner. For example, such cables may become eroded or damaged during use. Such damage may require costly workovers and delays in oil and gas production.

SUMMARY

In general, in one aspect, the disclosure relates to a downhole energy transmission system. The system can include a casing string having a number of casing pipe disposed within a wellbore, where the casing string has at least one wall forming a cavity. The system can also include a first remote electrical device disposed within the cavity of the casing string at a first location. The system can further include a first stripline cable disposed toward an outer surface of the casing string within the wellbore, where the first stripline cable transmits a first energy received from an energy source. The system can also include a second stripline cable adjacent to the first stripline cable at the first location, where the second stripline cable is electrically coupled to the first remote electrical device. The first energy transmitted through the first stripline cable passively reciprocates a second energy in the second stripline cable, where the second energy is used to operate the first remote electrical device.

In another aspect, the disclosure can generally relate to a method for providing energy in a wellbore of a subterranean formation. The method can include transmitting a first energy through a first stripline cable, where the first stripline cable is disposed toward an outer surface of a casing string within the wellbore. The method can also include generating a second energy in a second stripline cable using directional traveling wave coupling between the first stripline cable and the second stripline cable, where the second stripline cable is disposed within the casing string at a first location. The method can further include delivering, using the second stripline cable, the second energy to a first remote electrical device, where the second energy is used to operate the first remote electrical device at the first location.

These and other aspects, objects, features, and embodiments will be apparent from the following description and the appended claims.

BRIEF DESCRIPTION OF THE DRAWINGS

The drawings illustrate only example embodiments of methods, systems, and devices for stripline energy transmission in a wellbore and are therefore not to be considered limiting of its scope, as stripline energy transmission in a wellbore may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
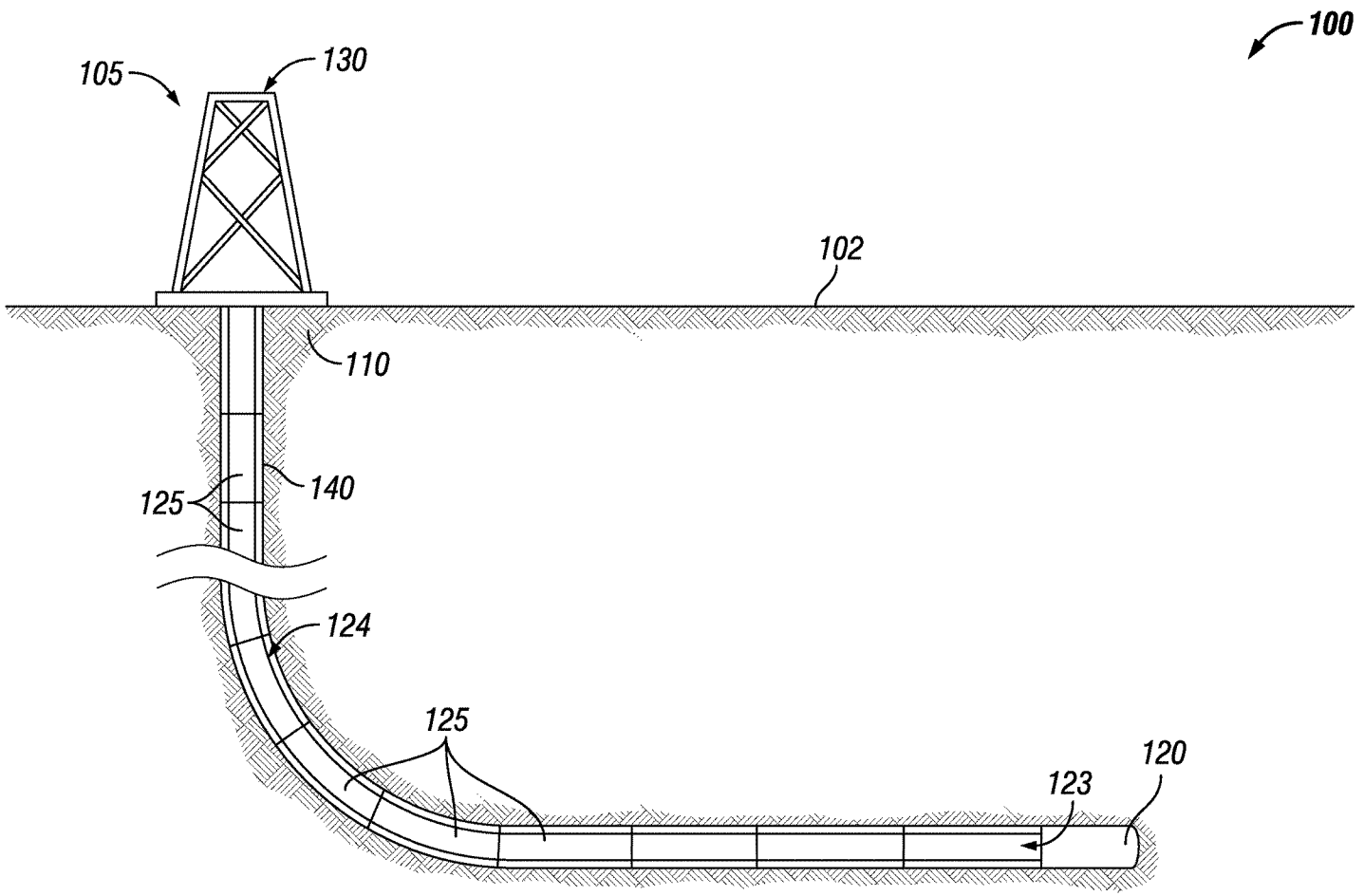
FIG. 1 shows a schematic diagram of a field system in which stripline energy transmission in a wellbore can be used in accordance with certain example embodiments.

The example embodiments discussed herein are directed to systems, apparatuses, and methods of stripline energy transmission in a wellbore. While the examples of stripline energy transmission shown in the figures and described herein are directed to use in a wellbore, examples of stripline energy transmission can also be used in other applications aside from a wellbore. Thus, the examples of stripline energy transmission described herein are not limited to use in a wellbore. A user as described herein may be any person that is involved with a field operation in a subterranean wellbore and/or transmitting energy within the subterranean wellbore for a field system. Examples of a user may include, but are not limited to, a roughneck, a company representative, a drilling engineer, a tool pusher, a service hand, a field engineer, an electrician, a mechanic, an operator, a consultant, a contractor, and a manufacturer's representative.

Example embodiments operate on traveling-wave transmission line theory and principles. Traveling-wave principles predict the existence of a "group" like electromagnetic energy with a 'direction' based on the associated wave energy vector, also called a Poynting Vector. The Poynting Vector is the result of the 'cross product' of the electric field vector and the magnetic field vector at any arbitrary location in the wave function. Coupled transmission line devices and sections can detect/share the energy with respect to the direction maintained in the second or 'coupled' line section. In some cases, such as in a pure traveling-wave directional coupler, there is no "resonant" activity. Instead, the technique used by example embodiments embodies only sensitivity to the Poynting Vector polarity.

The sensitivity of the directional coupler to the vector character of the traveling wave is its prime function. This type of directional coupler requires the second coupled line to be far less than ¼ wavelength to reduce frequency sensitivity. Such devices are frequently used to measure 'forward' and 'reverse' energy (e.g., power) in a transmission line to analyze power loss or "reflection" from an arbitrarily poorly terminated transmission line or antenna. While directional couplers of the 'non-resonant' type are not the most efficient devices for RF power transfer, they are used in these example embodiments because of the size of the various components used in a field operation and because of the probable long wavelength excitation practicality. In certain example embodiments, operating wavelengths are in the MHz realm of medium to long wavelength bands for lower loss per unit length (in this case, approximately a casing string) of transmission line.

In example embodiments, radio frequency (RF) or electromagnetic energy can be selectively coupled to a second near-field transmission line based on the direction of that incident wave. The coupler technique is particularly insensitive to waves of the opposite direction because the coupler is directional. An embodiment of this system includes the ability of each slave 'down-strip' device (e.g., stripline cable 450, described below) to have the ability to capture and rectify system transmitted RF power (using, for example, stripline cable 250, also described below) for localized circuit operation. That same RF power may be the carrier of information or data addressable to any or all of the serial remote member devices on the "strip". Therefore a 'master' strip type transmission line will pass in close proximity to one or more secondary (short) lines in example embodiments. In such a case, these second lines operate and are positioned as a component of some serial remote member addressable device of a long 'master' line length.

In example embodiments, there are multiple intelligent slave tools/devices communicated that each use a "slave" stripline cable to directionally couple to and communicate with a serial length of a "master" stripline cable. In the application of the directional coupling technique, waves traveling in the opposite direction, as viewed by a particular device, do not effectively couple to the second coupled stripline in the non-addressed device. This phenomenon is useful in example embodiments where there are multiple devices connected serially on the main stripline cable over some distance. In this way, returning wave transmissions from one serial device (e.g., sensor data) will not appear in the coupler of the other non-involved serial devices. Furthermore in this application an embodiment of each member slave device on the strip line is individually digitally addressable for separate instructions and/or responses.

Example embodiments of stripline energy transmission in a wellbore will be described more fully hereinafter with reference to the accompanying drawings, in which example embodiments of stripline energy transmission in a wellbore are shown. Stripline energy transmission in a wellbore may, however, be embodied in many different forms and should not be construed as limited to the example embodiments set forth herein. Rather, these example embodiments are provided so that this disclosure will be thorough and complete, and will fully convey the scope of stripline energy transmission in a wellbore to those of ordinary skill in the art. Like, but not necessarily the same, elements in the various figures are denoted by like reference numerals for consistency.

Terms such as "first," "second," "end," "inner," "outer," "master", "slave", "distal," and "proximal" are used merely to distinguish one component (or part of a component or state of a component) from another. Such terms are not meant to denote a preference or a particular orientation. Also, the names given to various components described herein are descriptive of one embodiment and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

FIG. 1 shows a schematic diagram of a land-based field system 100 in which stripline energy transmission can be used within a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., insert casing pipe, extract downhole materials) the wellbore 120. The field equipment 130 can be positioned and/or assembled at the surface 102. The field equipment 130 can include, but is not limited to, a derrick, a tool pusher, a clamp, a tong, drill pipe, a drill bit, example isolator subs, tubing pipe, an energy source, and casing pipe. The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of casing pipe to be inserted at a certain depth in the wellbore 120.

Inserted into and disposed within the wellbore are a number of casing pipe 125 that are coupled to each other to form the casing string 124. In this case, each end of a casing pipe 125 has mating threads disposed thereon, allowing a casing pipe 125 to be mechanically coupled to an adjacent casing pipe 125 in an end-to-end configuration. The casing pipes 125 of the casing string 124 can be mechanically coupled to each other directly or using a coupling device, such as a coupling sleeve.

Each casing pipe 125 of the casing string 124 can have a length and a width (e.g., outer diameter). The length of a casing pipe 125 can vary. For example, a common length of a casing pipe 125 is approximately 40 feet. The length of a casing pipe 125 can be longer (e.g., 60 feet) or shorter (e.g., 10 feet) than 40 feet. The width of a casing pipe 125 can also vary and can depend on the cross-sectional shape of the casing pipe 125. For example, when the cross-sectional shape of the casing pipe 125 is circular, the width can refer to an outer diameter, an inner diameter, or some other form of measurement of the casing pipe 125. Examples of a width in terms of an outer diameter can include, but are not limited to, 7 inches, 7⅝ inches, 8⅝ inches, 10¾ inches, 13⅜ inches, and 14 inches.

The size (e.g., width, length) of the casing string 124 is determined based on the information gathered using field equipment 130 with respect to the wellbore 120. The walls of the casing string 124 have an inner surface that forms a cavity 123 that traverses the length of the casing string 124. Each casing pipe 125 can be made of one or more of a number of suitable materials, including but not limited to stainless steel. In certain example embodiments, the casing pipes 125 are made of one or more of a number of electrically conductive materials. A cavity 123 can be formed by the walls of the casing string 124.

Figure 2:
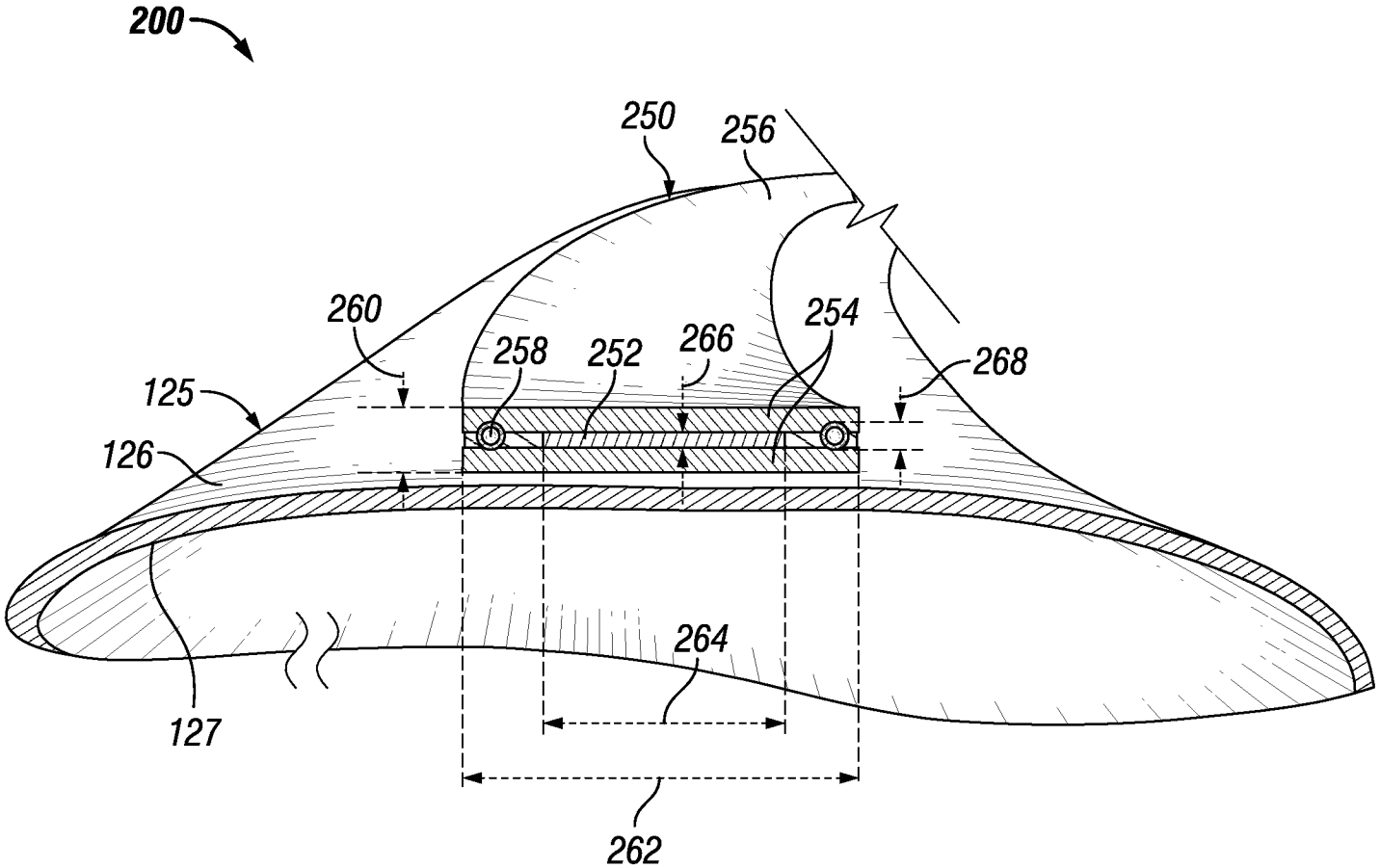
FIG. 2 shows a cross-sectional view of a casing pipe and stripline in accordance with certain example embodiments.

FIG. 2 shows a cross-sectional view of a portion of a field system 200 in accordance with certain example embodiments. In one or more embodiments, one or more of the features shown in FIG. 2 may be omitted, added, repeated, and/or substituted. Accordingly, embodiments of a field system should not be considered limited to the specific arrangements of components shown in FIG. 2.

Referring to FIGS. 1 and 2, the portion of the field system 200 of FIG. 2 includes a casing pipe 125 as described above with respect to FIG. 1 and an example stripline cable 250. In certain example embodiments, the stripline cable 250 (also called, for example, a primary cable 250, a main cable 250, and a master cable 250) includes an electrically conductive element 252 disposed between (or within) one or more insulating layers 254 of electrically non-conductive material. The stripline cable 250, when viewed cross-sectionally (as shown in FIG. 2), can have one or more of a number of shapes and sizes. For example, as shown in FIG. 2, the stripline cable 250, when in a natural state (not bent or otherwise deformed when inserted into the wellbore 120 with the casing string 124), can be rectangular in shape, having a width 262 and a height 260. Since the stripline cable 250 is disposed against, or proximate to, the outer surface 126 of the casing string 124 (including multiple casing pipes 125) within the wellbore 120, the height 260 is small so that the stripline cable 250 can be disposed between the outer surface 126 of the casing string 124 and the wall of the wellbore 120. For example, the height 260 of the stripline cable 250 can be approximately 0.025 inches.

The width 262 of the stripline cable 250 can be significantly larger than the height 260. For example, the width 262 can be approximately one inch. In certain example embodiments, the insulating layers 254 of the stripline cable 250 are made of a polymer that is rugged and electrically insulating. Examples of such a polymer can include, but are not limited to, a polycarbonate and Kapton®. (Kapton is a registered trademark of E. I. DuPont De Nemours and Company of Wilmington, Del.) The ruggedness of the insulating layers 254 is important to withstand scraping against the wellbore 120 as the casing string 124 is inserted into the wellbore 120 one casing pipe 125 at a time. The electrical insulating characteristic of the insulating layers 254 is important because the casing string is made of an electrically conductive material (e.g., stainless steel) In some cases, the insulating layers can be a dielectric.

The electrically conductive element 252 of the stripline cable 250 can carry energy (e.g., electrical power (e.g., voltage, current), RF waves) along some or all of its length. The electrically conductive element 252, when viewed cross-sectionally (as shown in FIG. 2), can have one or more of a number of shapes and sizes. For example, as shown in FIG. 2, the electrically conductive element 252, when in a natural state, can be rectangular in shape, having a width 264 and a height 266. The cross-sectional shape of the electrically conductive element 252 can be the same as, or different than, the cross-sectional shape of the entire stripline cable 250. Further, the proportion of the width 264 to the height 266 of the electrically conductive element 252 can be substantially the same as, or different than, the proportion of the width 262 to the height 260 of the entire stripline cable 250. For example, the height 266 of the electrically conductive element 252 can be approximately 0.005 inches, and the width 264 can be approximately 0.75 inches.

In certain example embodiments, one or more ground planes 256 are disposed on the top and/or bottom of the stripline cable 250. A ground plane 256 is made of electrically conductive material and can serve as a return path for current transmitted through the electrically conductive element 252. In addition, or in the alternative, as shown below with respect to FIGS. 3 and 4, the end of the stripline cable 250 can be coupled to a terminator, which has an impedance and completes the circuit for current that flows through the electrically conductive element 252.

Optionally, one or more optical fibers 258 can be disposed between (or within) the one or more insulating layers 254 adjacent to the electrically conductive element 252. An optical fiber 258 can be flexible and allow light waves, power (especially for lower power levels), and/or other forms of energy to travel down some or all of its length. An optical fiber 258 can be made from any one or more of a number of materials, including but not limited to glass, silica, and plastic.

Figure 3:
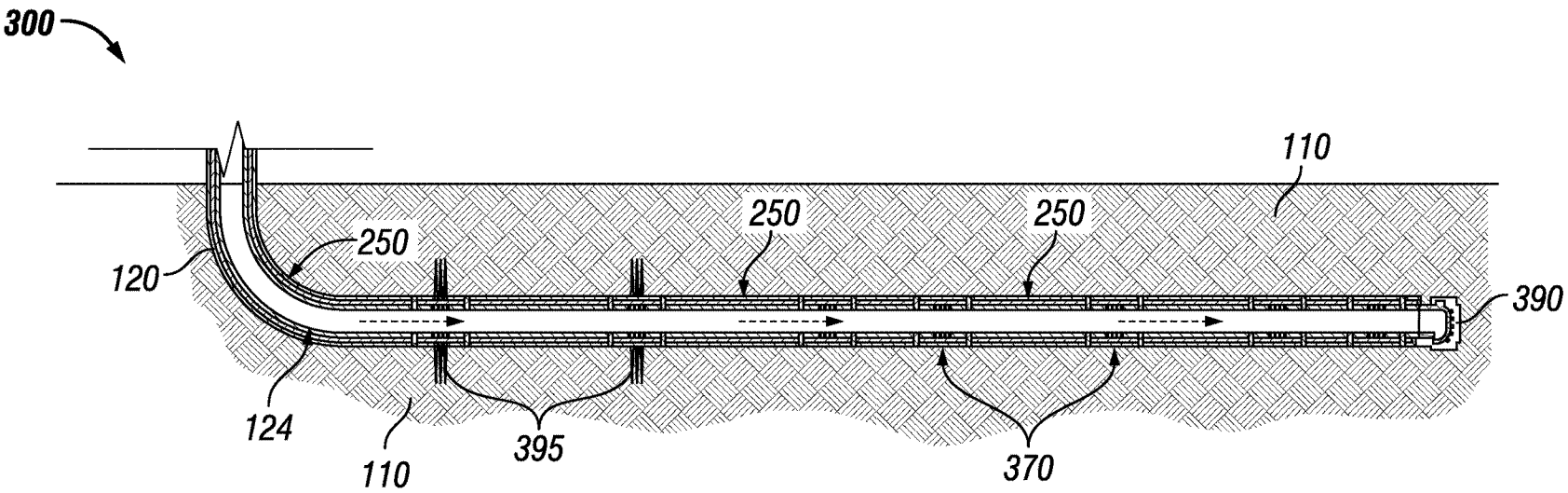
FIG. 3 shows a cross-sectional side view of a subterranean portion of a field system using stripline energy transmission in the wellbore in accordance with certain example embodiments.

FIG. 3 shows a cross-sectional side view of a subterranean portion of a field system 300 using stripline energy transmission in the wellbore in accordance with certain example embodiments. In one or more embodiments, one or more of the features shown in FIG. 3 may be omitted, added, repeated, and/or substituted. Accordingly, embodiments of a field system should not be considered limited to the specific arrangements of components shown in FIG. 3.

Referring to FIGS. 1-3, the portion of the field system 300 includes a casing string 124 disposed within a wellbore 120 in a formation 110. Disposed between the casing string 124 and the wall that defines the wellbore 120 is a stripline cable 250. As can be seen in FIG. 3, the stripline cable 250 runs along substantially all of the length of the casing string 124. In certain example embodiments, the stripline cable 250 is continuous along its length. Alternatively, the stripline cable 250 can include multiple segments that are spliced together to maintain electrical continuity between the various segments of the stripline cable 250.

At the end of the stripline cable 250, within the wellbore 120, is a terminator 390 (also called a terminator load 390). The terminator 390 can be a resistive element that completes a circuit for energy flowing through the electrically conductive element 252 of the stripline cable 250. The size (e.g., resistance, inductance, capacitance) and configuration (e.g., resistors, inductors, capacitors) of the terminator 390 can vary. For example, if the impedance of electrically conductive element 252 of the stripline cable 250 is 50 ohms, the terminator 390 can be a 50 ohm equivalent circuit that includes an inductor, a resistor, and a capacitor electrically coupled to each other. While one end of the terminator 390 can be electrically coupled to the electrically conductive element 252 of the stripline cable 250, the other end of the terminator 390 can be electrically connected to the casing string 124, which acts as a ground (e.g., earth ground). In certain embodiments, the ground is the casing string 124 on which the stripline cable 250 is disposed.

In certain example embodiments, along the length of the casing string 124 are disposed a number of remote device sleeves 370. Each remote device sleeve 370 can house one or more remote devices. Further, each remote device sleeve 370 can be part of the casing string 124 and are positioned at different locations along the casing string 124. For example, each end of a remote device sleeve 370 can be coupled to a casing pipe 125. Each sleeve remote device 370 can include one or more remote electrical devices that receive power and/or control signals from the stripline cable 250. For example, as shown in FIG. 3, if the remote electrical device within a remote device sleeve 370 is a charge for a fracturing operation, fractures 395 can be generated in the formation 110 when the charges are activated by power and/or control signals received from the stripline cable 250. The remote device sleeve 370 and the remote electrical devices housed in the remote device sleeve 370 are discussed in more detail below with respect to FIG. 4.

Figure 4:
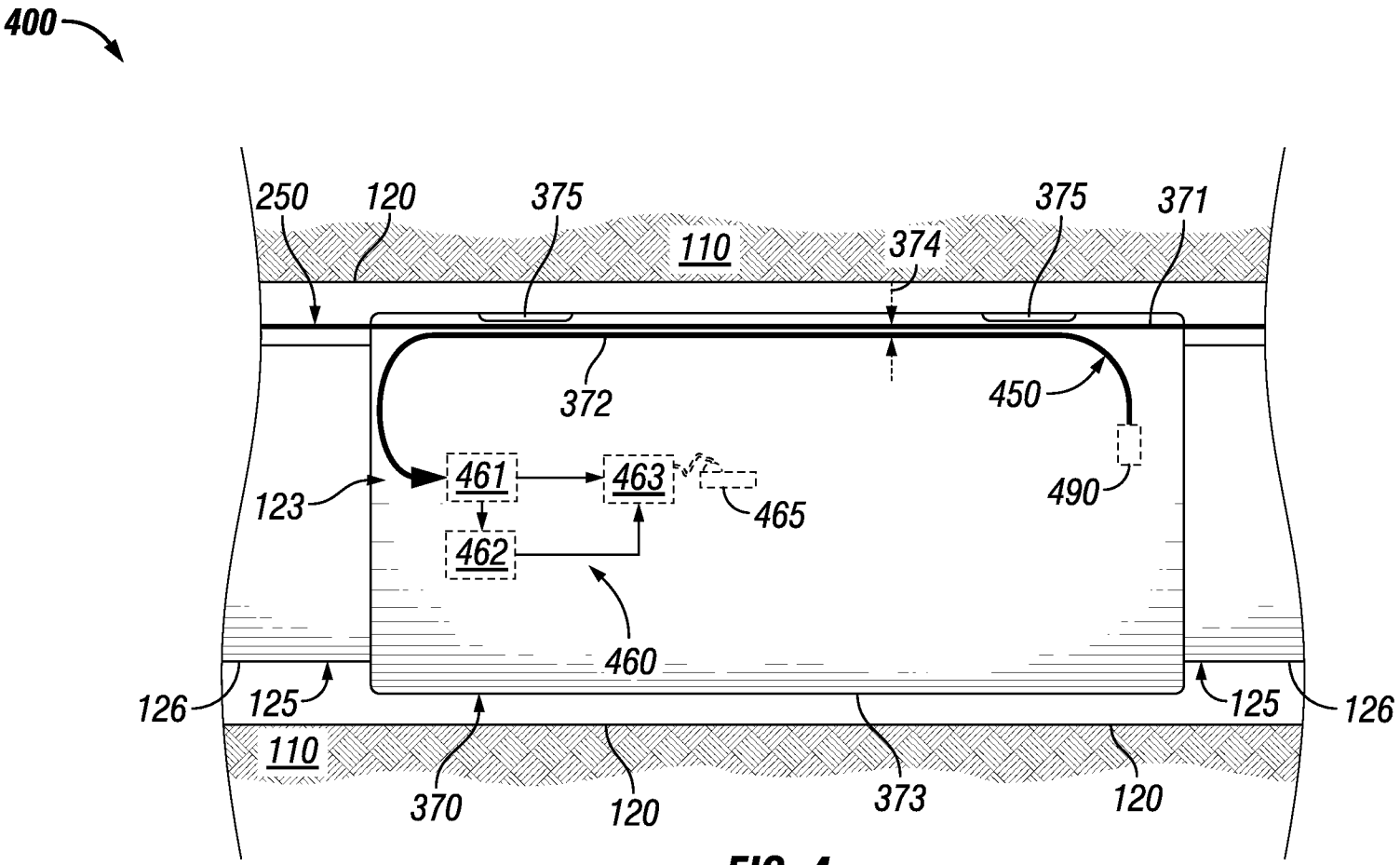
FIG. 4 shows a cross-sectional side view of a remote device sleeve housing a remote electrical device with stripline energy transmission in accordance with certain example embodiments.

FIG. 4 shows a cross-sectional side view of a subterranean portion of a field system 400 that includes a sleeve with stripline energy transmission in accordance with certain example embodiments. In one or more embodiments, one or more of the features shown in FIG. 4 may be omitted, added, repeated, and/or substituted. Accordingly, embodiments of a field system should not be considered limited to the specific arrangements of components shown in FIG. 4.

Referring to FIGS. 1-4, each end of the remote device sleeve 370 of FIG. 4 can be coupled to a casing pipe 125. Like the casing pipe 125, the sleeve can have at least one wall 373 that forms the cavity 123 within the casing string 124. The remote device sleeve 370 can have the same length, or a different length, compared to a casing pipe 125. The remote device sleeve 370 can be coupled to the casing pipes 125 in the same way, or in a different way, that other casing pipes 125 in the casing string 124 are coupled to each other. The outer perimeter of the wall 373 of the remote device sleeve 370 can have substantially the same or a different shape, when viewed cross-sectionally along its length, as the adjacent cross-sectional shape of the outer surface 126 of the wall of the casing pipe 125. Similarly, the inner perimeter of the wall 373 of the remote device sleeve 370 can have substantially the same or a different shape, when viewed cross-sectionally along its length, as the adjacent cross-sectional shape of the inner surface of the wall of the casing pipe 125.

In certain example embodiments, the stripline cable 250, disposed on the toward an outer surface of the casing string 124 within the wellbore 120 in the subterranean formation 110, is disposed within a channel 371 disposed in the outer surface of the wall 373 of the remote device sleeve 370 that houses a remote electrical device. In addition, or in the alternative, a similar channel can be disposed in the outer surface 126 of one or more casing pipes 125. In such a case, the stripline cable 250 can be positioned within the channels. When the stripline cable 250 is positioned within the channel 371 (or in a channel of a casing pipe 125), one or more coupling (also called retaining) devices 375 (e.g., a clamp, as shown in FIG. 4) can be used to help retain the stripline cable 250 within the channel 371. The coupling devices 375 can be resilient (e.g., spring-like) to maintain the stripline cable 250 within the channel 371 for extended periods of time and during installation of the casing string 124 into the wellbore 120.

In certain example embodiments, a remote device sleeve 370 can include a stripline cable 450 disposed within the channel 372 and at least one remote electrical device 460 disposed within the cavity 123 formed by the wall 373 of the remote device sleeve 370. The stripline cable 450 (also called, for example, a secondary cable 450 and a slave cable 450) can be substantially the same as the stripline cable 250 of FIGS. 2 and 3, except as described below. The stripline cable 450 can be at least partially disposed within the cavity 123 formed by the remote device sleeve 370, while at least another portion of the stripline cable 450 can be disposed in the channel 372 formed in the wall 373 of the remote device sleeve 370. As a result, the length (e.g., 10 feet) of the stripline cable 450 is significantly shorter than the length (e.g., 5,000 feet) of the stripline cable 250. One end of the stripline cable 450 can be electrically coupled to a terminator 490, which can be substantially the same as the terminator 390 of FIG. 3 described above. The other end of the stripline cable 450 can be electrically coupled to the remote electrical device 460. Each remote electrical device 460, corresponding to a remote device sleeve 370 within the casing string 124, can be positioned at a different location within the wellbore 120.

The remote electrical device 460 can include one or more of a number of components. For example, as shown in FIG. 4, the remote electrical device 460 can include a rectifier 461, a receiver 462, a control module 463, and an instrument 465. The rectifier 461 and the receiver 462 can work in conjunction to capture the directional wave transfer. Specifically, the receiver 462 can receive the oscillating current flowing through the stripline cable 450. In such a case, the oscillating current flowing through the first stripline cable 250 is passively reciprocated to the second stripline cable 450. The proximity between the stripline cable 250 and the stripline cable 450 (in this example, separated by distance 374) allows the passive reciprocation to occur. In such a case, the stripline cable 250 and the stripline cable 450 can form a power transfer coupler (also called a directional coupler or an energy transfer coupler or a power transfer coupling mechanism).

The rectifier 461 can take the oscillating current received by the receiver 462 and generate a type (e.g., alternating current power, direct current power, radio frequency) and amount of energy for use by the instrument 465. The rectifier 461 can include any of a number of energy manipulation components, including but not limited to a transformer, an inverter, and a converter. The control module 463 can receive the power signals (which can include control signals) generated by the rectifier 461 and process the power signals based on the control signals. For example, example embodiments can send energy (including power and/or control signals) through the stripline cable 250, where the energy is addressed to one or more particular remote electrical devices 460 located in the wellbore 120. In such a case, the control module 463 can determine whether the energy signals are addressed to the associated instrument 465. If the energy signals are addressed to the associated instrument 465, the control module 463 delivers the energy signals to the instrument 465. If the energy signals are not addressed to the associated instrument 465, the control module 463 does not deliver the energy signals to the instrument 465.

In certain example embodiments, the control module 463 (or some other portion of the remote electrical device 460) can also be used to send signals to a user. In such a case, such signals can take the reverse path of what is described above. Specifically, the remote electrical device 460 can generate a signal that is sent through the second stripline cable 450, passively reciprocated to the first stripline cable 250, and delivered to the surface, where the signal in the first stripline cable 250 is received and interpreted for a user. Examples of a signal sent by the electrical device can include, but are not limited to, a measurement (as for a pressure or temperature), confirmation of receipt of a signal by the electrical device, communication of a status (e.g., operating normally) of the remote electrical device 460, and confirmation that an operation has been performed by the electrical device 460.

The rectifier 461, the receiver 462, and the control module 463 can each be made of discrete components (e.g., resistors, capacitors, diodes), integrated circuits, or any combination thereof. The instrument 465 of the remote electrical device 460 performs an action with respect to a field operation and can take many different shapes and forms. Examples of an instrument 465 can include, but are not limited to, a sensor (e.g., temperature sensor, pressure sensor, a gas sensor, flow rate sensor), a valve, and a charge (as for a fracturing operation). The instrument 465 can be a discrete device from the rectifier 461, the receiver 462, and/or the control module 463, where the instrument 465 is operatively coupled to at least one other component of the remote electrical device 460. Alternatively, the instrument 465, the rectifier 461, the receiver 462, and the control module 463 can be integrated into a single housing.

At least a portion of the second stripline cable 450 can be disposed against or near a bottom surface of the channel 372 of the remote device sleeve 370 proximate to the first stripline cable 250 adjacent to the second stripline cable 450. In certain example embodiments, the first stripline cable 250 and the second stripline cable 450 are in intimate contact with each other, where the insulting layers of the first stripline cable 250 and the second stripline cable 450 are in physical or near physical contact with each other. In such a case, the first stripline cable 250 and the second stripline cable 450 can be disposed in the same channel in the remote device sleeve 370.

In some cases, the stripline cable 450 can be disposed within a channel 372 disposed in the inner surface of the wall 373 of the remote device sleeve 370. When the second stripline cable 450 is positioned within the channel 372, one or more coupling (also called retaining) devices (not shown, but substantially similar to the coupling devices 375 described above) can be used to help retain the second stripline cable 450 within the channel 372.

The first stripline cable 250 and the second stripline cable 450 can be disposed, at least in part (e.g., where energy is transmitted from one to the other), on the outer surface of the wall 373 of the remote device sleeve 370. Alternatively, the first stripline cable 250 and the second stripline cable 450 can be disposed, at least in part, on the inner surface of the wall 373 of the remote device sleeve 370. As yet another alternative, as stated above, the first stripline cable 250 and the second stripline cable 450 can be disposed, at least in part, in one or more channels disposed in the wall 373 of the remote device sleeve 370.

If the outer perimeter of the remote device sleeve 370 is larger than the outer perimeter of the casing pipe 125, then the various stripline cables (e.g., first stripline cable 250, second stripline cable 450) can be disposed, at least in part, on the outer surface of the casing string 124. In such a case, the first stripline cable 250 can be disposed outside (e.g., against) the outer surface of the various casing pipe 125.

Figure 5:
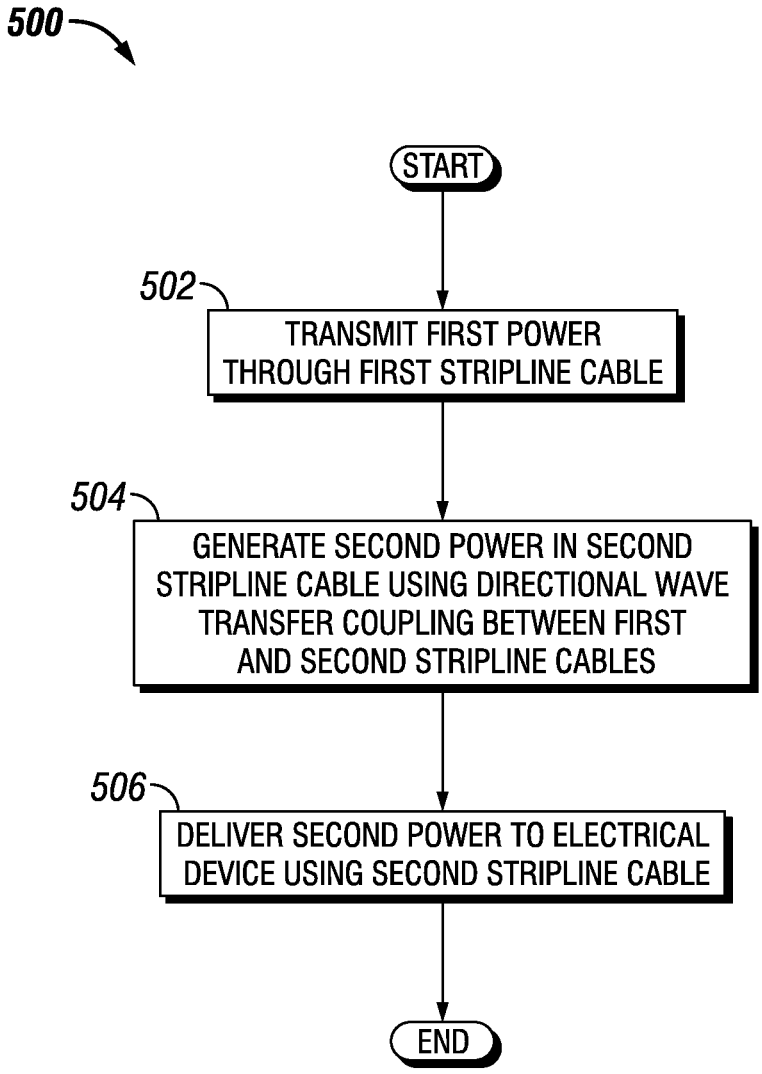
FIG. 5 shows a flow chart of a method for transmitting energy to downhole remote electrical devices using stripline in accordance with one or more example embodiments.

FIG. 5 shows a flow chart of a method 500 for providing energy in a wellbore of a subterranean formation in accordance with one or more example embodiments. While the various steps in this flowchart are presented and described sequentially, one of ordinary skill will appreciate that some or all of the steps may be executed in different orders, may be combined or omitted, and some or all of the steps may be executed in parallel. Further, in certain example embodiments, one or more of the steps described below may be omitted, repeated, and/or performed in a different order. In addition, a person of ordinary skill in the art will appreciate that additional steps, omitted in FIG. 5, may be included in performing these methods. Accordingly, the specific arrangement of steps shown in FIG. 5 should not be construed as limiting the scope.

Referring now to FIGS. 1-5, the example method 500 begins at the START step and continues to step 502. In step 502, energy is transmitted through a first stripline cable 250. In certain example embodiments, the first stripline cable 250 is disposed toward an outer surface of a casing string 124 within the wellbore 120. In such a case, the casing string can include one or more casing pipes 125 and one or more remote device sleeves 370 that are coupled to each other. The energy can be generated by an energy source that is electrically coupled to a proximal end (e.g., at the surface 102) of the first stripline cable 250. The energy transmitted through the first stripline cable 250 can be of any type and/or level required. For example, the energy can include power signals and control signals. In some cases, the first stripline cable 250 can be positioned, at least in part, in a channel disposed within some or all of the casing string 124. In such a case, the first stripline cable 250 can be held within the channel by at least one coupling (also called retaining) device 375.

In step 504, power in a second stripline cable 450 is generated. In certain example embodiments, the energy in the second stripline cable 450 is generated using directional wave transfer coupling between the first stripline cable 250 and the second stripline cable 450. The second stripline cable 450 can be disposed within the casing string 124 at a first location. Specifically, in certain example embodiments, at least a portion of the second stripline cable 450 can be disposed within a cavity 123 formed by the remote device sleeve 370 of the casing string 124. In addition, or in the alternative, at least a portion of the second stripline cable 450 can be disposed within a channel 372 disposed on an inner surface of the wall 373 of the remote device sleeve 370.

In step 506, energy is delivered to a remote electrical device 460. In certain example embodiments, the energy is delivered to the remote electrical device 460 using the second stripline cable 450. The energy can be used to operate the remote electrical device 460 at the first location. In some cases, the energy delivered to a remote electrical device 460 is read for instructions specific for that remote electrical device 460 before the energy is used to operate the remote electrical device 460. When step 506 is completed, the method 500 ends at the END step. Alternatively, the method 500 can repeat any of a number of times for any of a number of remote electrical devices 460. In addition, any remote electrical device 460 can generate energy (e.g., control signals) that reverses the steps in the method 500, so that the power generated by a remote electrical device 460 is ultimately received by a user.

As discussed above, the stripline cable can be disposed against, or proximate to, the outer surface of the casing string (including multiple casing pipes) within a wellbore. Alternatively, in certain example embodiments, the stripline cable can be disposed against, or proximate to, the outer surface of the tubing string disposed within the annulus of the casing. In such a case, the stripline cable can be used to provide power to one or more electrical devices (e.g., gas lift valves) that operate relative to the tubing string. FIGS. 6-10 below describe these alternative embodiments in further detail.

In order to streamline this application, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number, and corresponding components in other figures have the identical last two digits. For example, the remote device sleeve 870 described in FIGS. 8 and 9 can be substantially the same as the remote device sleeve 370 described above with respect to FIGS. 3 and 4, except as described below with respect to FIGS. 8 and 9.

Figure 6:
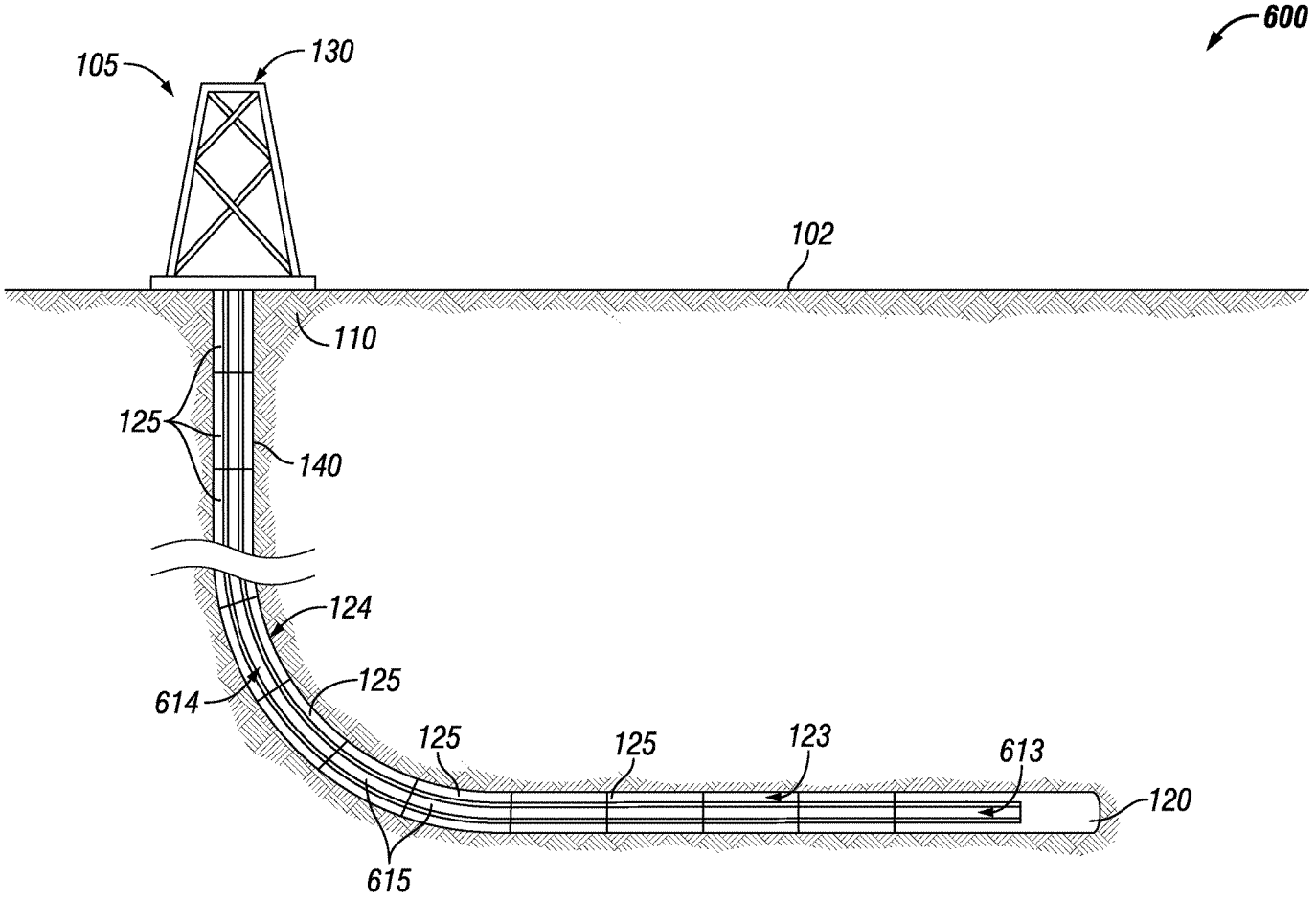
FIG. 6 shows a schematic diagram of a field system in which stripline energy transmission in a wellbore can be used in accordance with certain example embodiments.

FIG. 6 shows a schematic diagram of another field system 600 in which stripline energy transmission in a wellbore can be used in accordance with certain example embodiments. Referring to FIGS. 1-6, the field system 600 of FIG. 6 is substantially the same as the field system 100 of FIG. 1 described above, except as described below. Specifically, in this case, a tubing string 614 is disposed within the cavity 123 formed by the casing string 124. The tubing string 614 is made up of a number of tubing pipes 615 that are coupled to each other at the surface 102 and inserted inside the cavity 123 formed by the casing string 124.

The collection of tubing pipes 615 can be called a tubing string 614. The tubing pipes 615 of the tubing string 614 are mechanically coupled to each other end-to-end, usually with mating threads. The tubing pipes 615 of the tubing string 614 can be mechanically coupled to each other directly or using a coupling device, such as a remote device sleeve 870 (shown below with respect to FIGS. 8 and 9). Each tubing pipe 615 of the tubing string 614 can have a length and a width (e.g., outer diameter). The length of a tubing pipe 615 can vary. For example, a common length of a tubing pipe 615 is approximately 30 feet. The length of a tubing pipe 615 can be longer (e.g., 40 feet) or shorter (e.g., 10 feet) than 30 feet. Also, the length of a tubing pipe 615 can be the same as, or different than, the length of an adjacent casing pipe 125.

The width of a tubing pipe 615 can also vary and can depend on one or more of a number of factors, including but not limited to the target depth of the wellbore 120, the total length of the wellbore 120, the inner diameter of the adjacent casing pipe 125, and the curvature of the wellbore 120. The width of a tubing pipe 615 can refer to an outer diameter, an inner diameter, or some other form of measurement of the tubing pipe 615. Examples of a width in terms of an outer diameter for a tubing pipe 615 can include, but are not limited to, 7 inches, 5 inches, and 4 inches.

In some cases, the outer diameter of the tubing pipe 615 can be such that a gap exists between the tubing pipe 615 and an adjacent casing pipe 125. The walls of the tubing pipe 615 have an inner surface that forms a cavity 613 (also sometimes called an annulus 613) that traverses the length of the tubing pipe 615. The tubing pipe 615 can be made of one or more of a number of suitable materials, including but not limited to steel.

Figure 7:
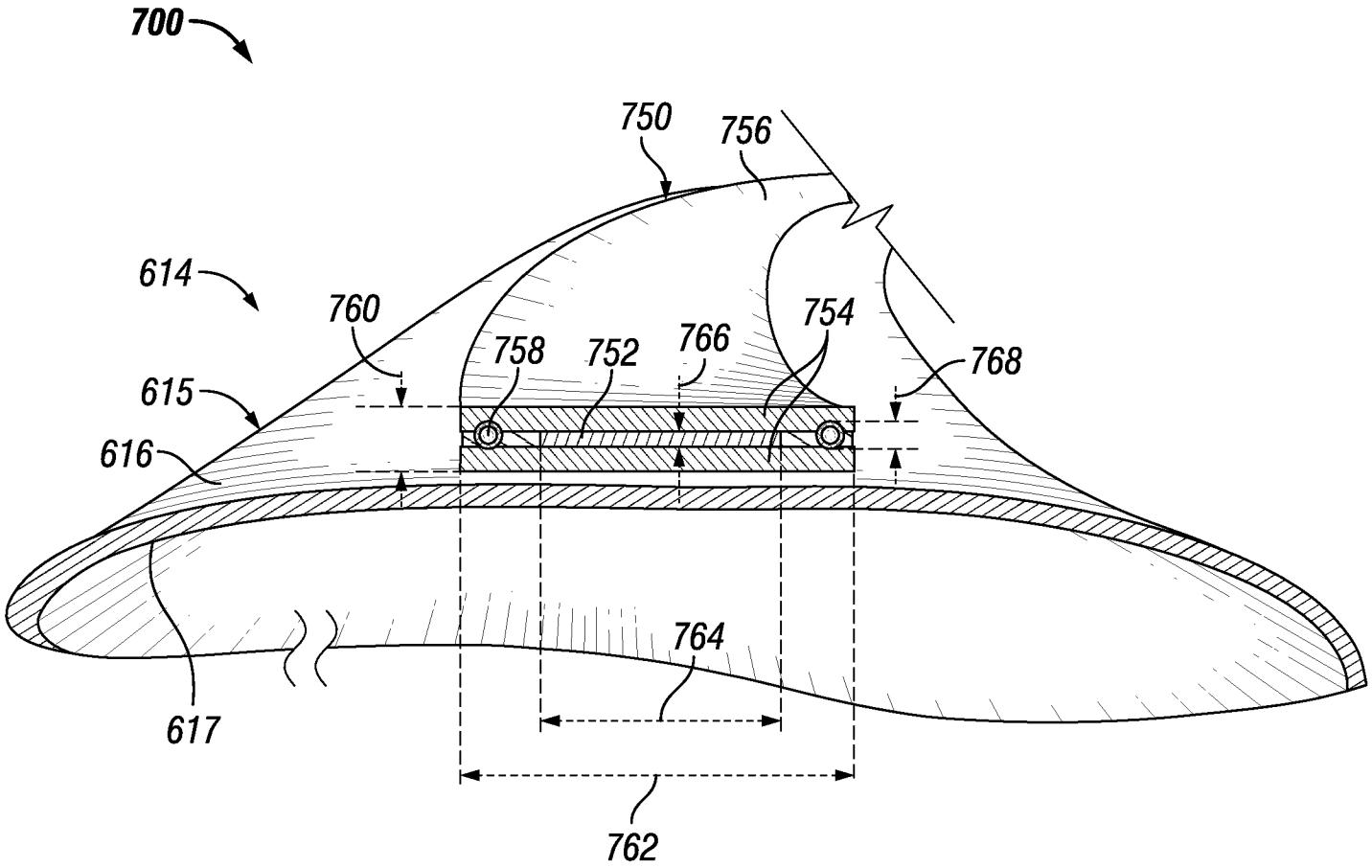
FIG. 7 shows a cross-sectional view of a casing pipe and stripline in accordance with certain example embodiments.

FIG. 7 shows a cross-sectional view of a casing pipe and stripline in accordance with certain example embodiments. Referring to FIGS. 1-7, the portion of the field system 700 of FIG. 7 includes a casing pipe 123 as described above with respect to FIG. 6 and an example stripline cable 750. The stripline cable 750 of FIG. 7 can be substantially the same as the stripline cable 250 discussed above with respect to FIG. 2. For example, the stripline cable 750 of FIG. 7 can include an electrically conductive element 752 disposed between (or within) one or more insulating layers 754 of electrically non-conductive material.

As another example, the stripline cable 750 can have a width 762 and a height 760. As yet another example, the electrically conductive element 752 of the stripline cable 750 can carry energy (e.g., an electromagnetic directional traveling wave, a RF wave) along some or all of its length, and the electrically conductive element 752 can have a width 764 and a height 766. As still another example, the stripline cable 750 can include one or more optional ground planes 756 and/or one or more optical fibers 758, which can be substantially similar to the ground planes 256 and the optical fibers 258 described above with respect to FIG. 2.

Figure 8:
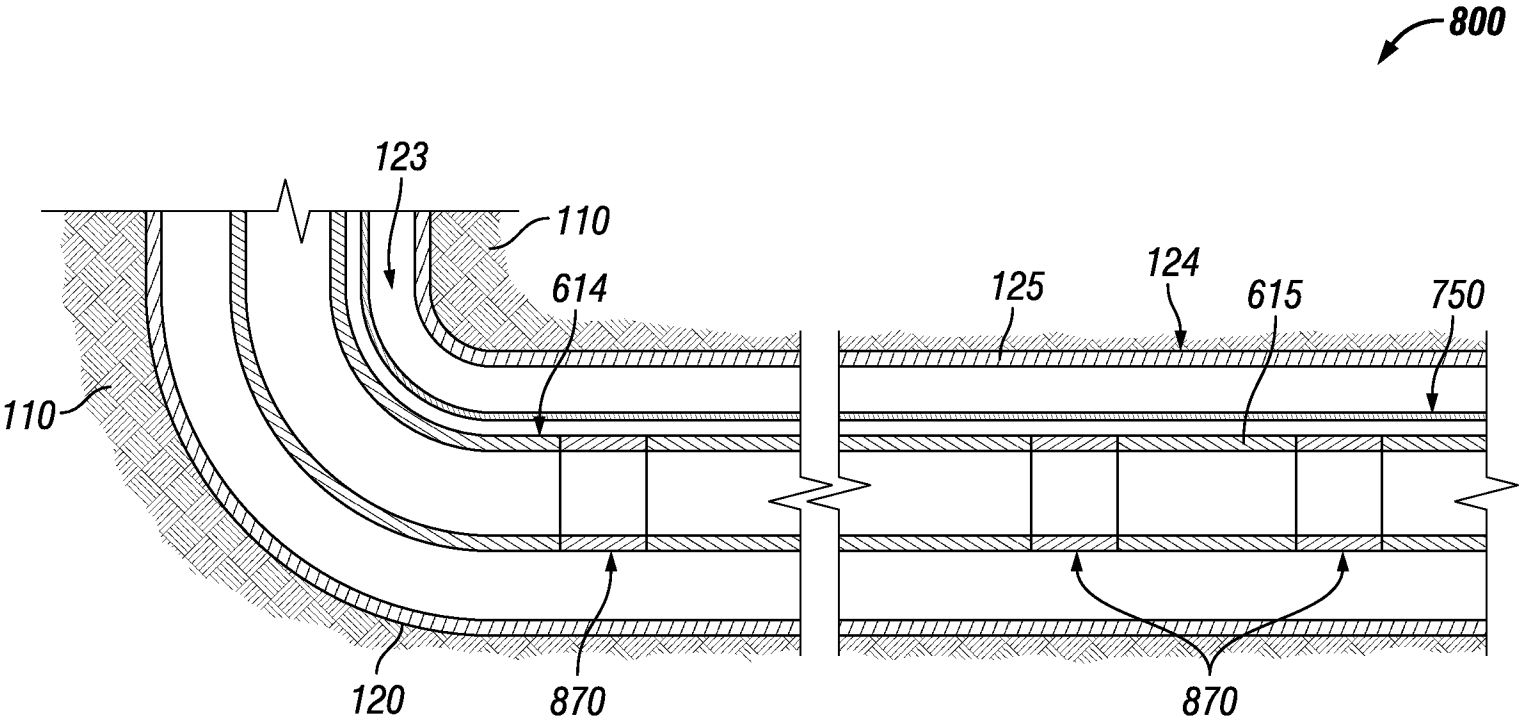
FIG. 8 shows a cross-sectional side view of a subterranean portion of a field system using stripline energy transmission in the wellbore in accordance with certain example embodiments.

FIG. 8 shows a cross-sectional side view of a subterranean portion of a field system 800 using stripline energy transmission in the wellbore in accordance with certain example embodiments. Referring to FIGS. 1-8, the portion of the field system 800 of FIG. 8 includes a casing string 124 disposed within a wellbore 120 in a formation 110, as well as a tubing string 614 disposed within the annulus 123 formed by the casing string 124. Disposed between the tubing string 614 and the casing string 124 is a stripline cable 750, such as the stripline cable 750 of FIG. 7. As can be seen in FIG. 8, the stripline cable 750 runs along substantially all of the length of the tubing string 614. In certain example embodiments, the stripline cable 750 is continuous along its length. Alternatively, the stripline cable 750 can include multiple segments that are spliced together to maintain electrical continuity between the various segments of the stripline cable 750.

At the end of the stripline cable 750, within the wellbore 120, can be a terminator, such as the terminator 390 of FIG. 3 above. While one end of the terminator can be electrically coupled to the electrically conductive element 752 of the stripline cable 750, the other end of the terminator can be electrically connected to the tubing string 614 and/or the casing string 124, which acts as a ground (e.g., earth ground). In certain example embodiments, along the length of the tubing string 614 are disposed a number of remote device sleeves 870, which can be substantially similar to the remote device sleeves 370 discussed above, except as described below. For example, each remote device sleeve 870 can house one or more remote devices (e.g., a gas lift valve) that receive power and/or control signals from the stripline cable 750. As another example, each remote device sleeve 870 can be part of the tubing string 614 and is positioned at different locations along the tubing string 614.

Figure 9:
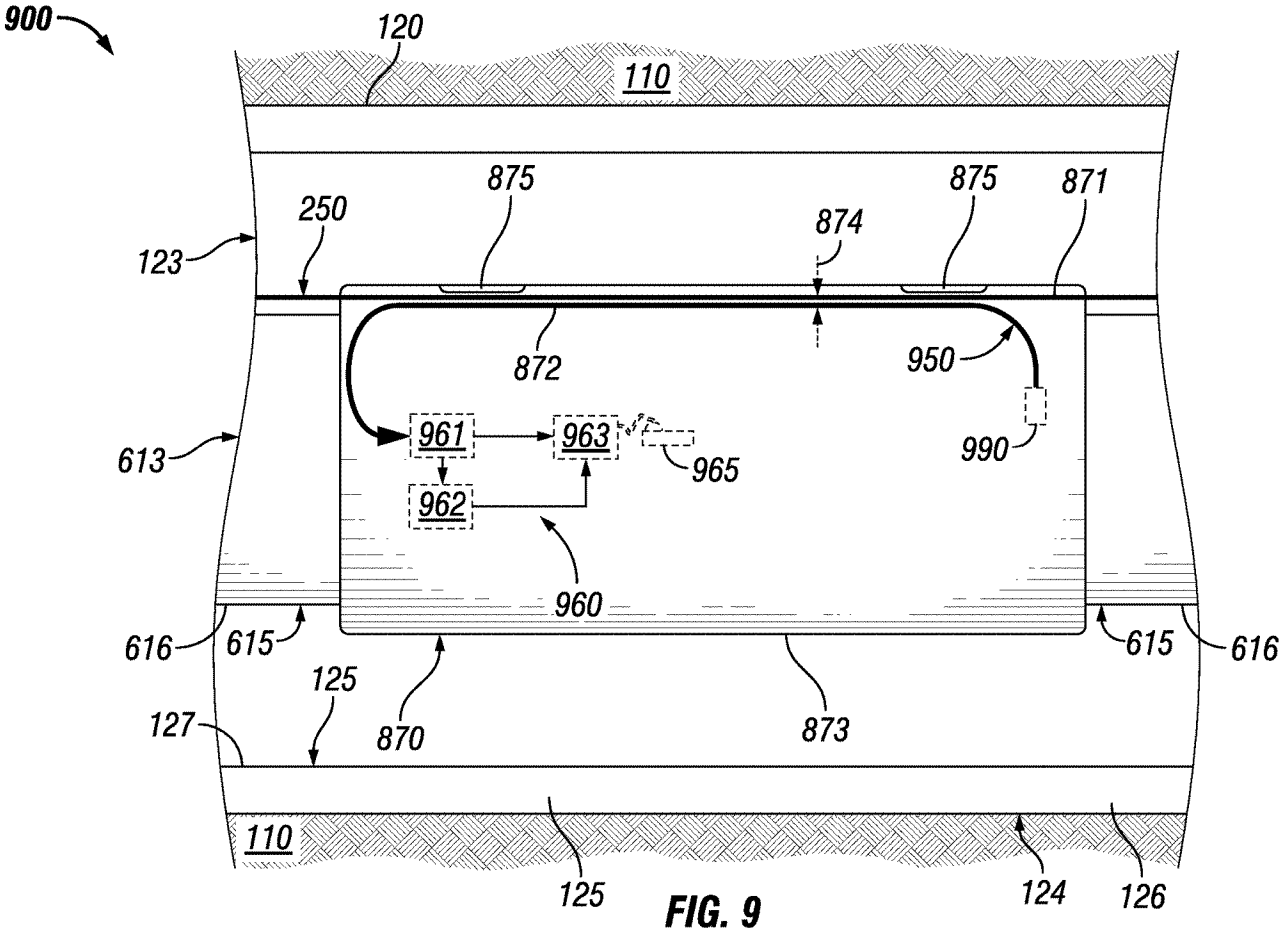
FIG. 9 shows a cross-sectional side view of another remote device sleeve housing a remote electrical device with stripline energy transmission in accordance with certain example embodiments.

FIG. 9 shows a cross-sectional side view of another remote device sleeve housing a remote electrical device with stripline energy transmission in accordance with certain example embodiments. Referring to FIGS. 1-9, the portion of the system 900 of FIG. 9 can be substantially the same as the portion of the system 400 of FIG. 4, except as discussed below. For example, the remote electrical device 960 of FIG. 9 can include a rectifier 961, a receiver 962, a control module 963, and an instrument 965, which can be substantially the same as the rectifier 461, the receiver 462, the control module 463 (also called a controller 463), and the instrument 465 of the remote electrical device 460 of FIG. 4. In this example, the remote electrical device 960 is used for an operation and/or procedure within the cavity 613 formed by the tubing string 614.

Each end of the remote device sleeve 970 of FIG. 9 can be coupled to a tubing pipe 615 of the tubing string 614. Like the tubing pipe 615, the remote device sleeve 870 can have at least one wall 873 that forms the cavity 613 within the tubing string 614. The remote device sleeve 870 can have the same length, or a different length, compared to a tubing pipe 615. The remote device sleeve 870 can be coupled to the tubing pipes 615 in the same way, or in a different way, that other tubing pipes 615 in the tubing string 614 are coupled to each other. The outer perimeter of the wall 873 of the remote device sleeve 870 can have substantially the same shape or a different shape, when viewed cross-sectionally along its length, as the adjacent cross-sectional shape of the outer surface 626 of the wall of the tubing pipe 615. Similarly, the inner perimeter of the wall 873 of the remote device sleeve 870 can have substantially the same shape or a different shape, when viewed cross-sectionally along its length, as the adjacent cross-sectional shape of the inner surface of the wall of the tubing pipe 615.

In certain example embodiments, the stripline cable 750, disposed on the toward an outer surface of the tubing string 614 within the annulus 123 of the casing string 124 disposed in the wellbore 120 in the subterranean formation 110, is disposed within a channel 871 disposed in the outer surface of the wall 873 of the remote device sleeve 870 that houses the remote electrical device 960. In addition, or in the alternative, a similar channel can be disposed in the outer surface 616 of one or more tubing pipes 615. In such a case, the stripline cable 750 can be positioned within the channels. When the stripline cable 750 is positioned within the channel 871 of the remote device sleeve 870 (or in a channel of a tubing pipe 615), one or more coupling (also called retaining) devices 875, substantially similar to the coupling devices 375 described above, can be used.

In certain example embodiments, a remote device sleeve 870 can include a stripline cable 950 disposed within the channel 872 and at least one remote electrical device 960 disposed within the cavity 613 formed by the wall 873 of the remote device sleeve 870. In some cases, channel 871 and channel 872 can form a continuous channel. The stripline cable 950 (also called, for example, a secondary cable 950 and a slave cable 950) can be substantially the same as the stripline cable 450 of FIG. 4. The stripline cable 950 can be at least partially disposed within the cavity 613 formed by the remote device sleeve 870, while at least another portion of the stripline cable 950 can be disposed in the channel 872 formed in the wall 873 of the remote device sleeve 870.

As a result, the length (e.g., 10 feet) of the stripline cable 950 is significantly shorter than the length (e.g., 5,000 feet) of the stripline cable 750. One end of the stripline cable 950 can be electrically coupled to a terminator 990, which can be substantially the same as the terminators described above. The other end of the stripline cable 950 can be electrically coupled to the remote electrical device 960. Each remote electrical device 960, corresponding to a remote device sleeve 870 within the tubing string 614, can be positioned at a different location within the annulus 123 formed by the casing string 124. An example of a gas lift valve assembly that is used as a remote electrical device 960 and a remote device sleeve 870 is shown in FIGS. 10A-10C below.

Figure 10A:
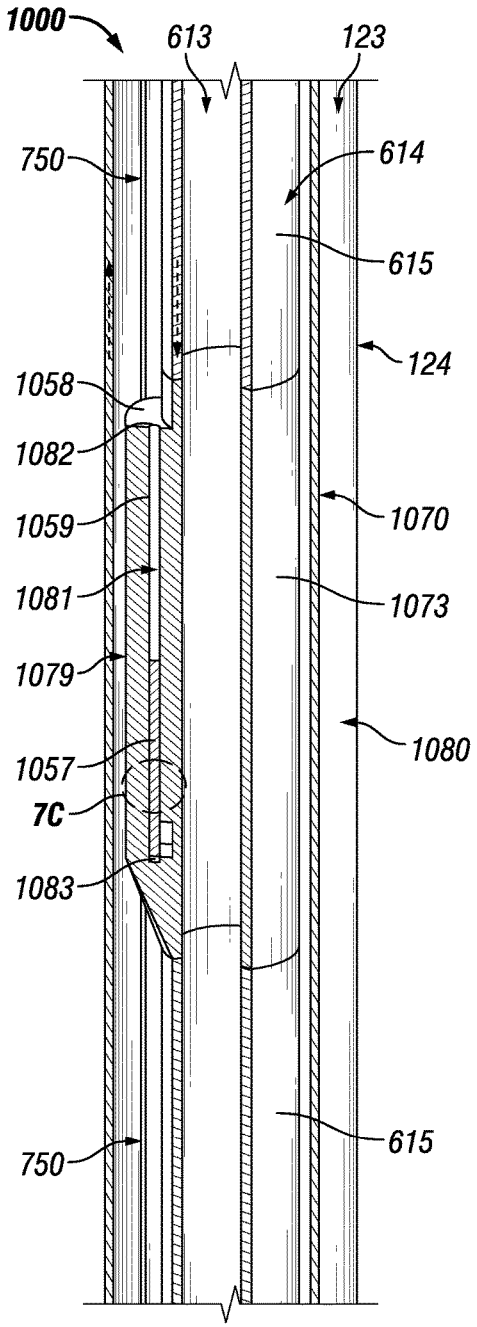
FIGS. 10A-10C show a portion of a system that includes a gas lift valve assembly in accordance with certain example embodiments.
Figure 10C:
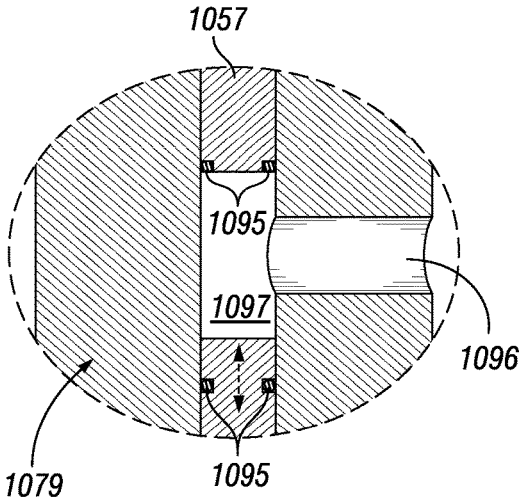
Figure 10B:
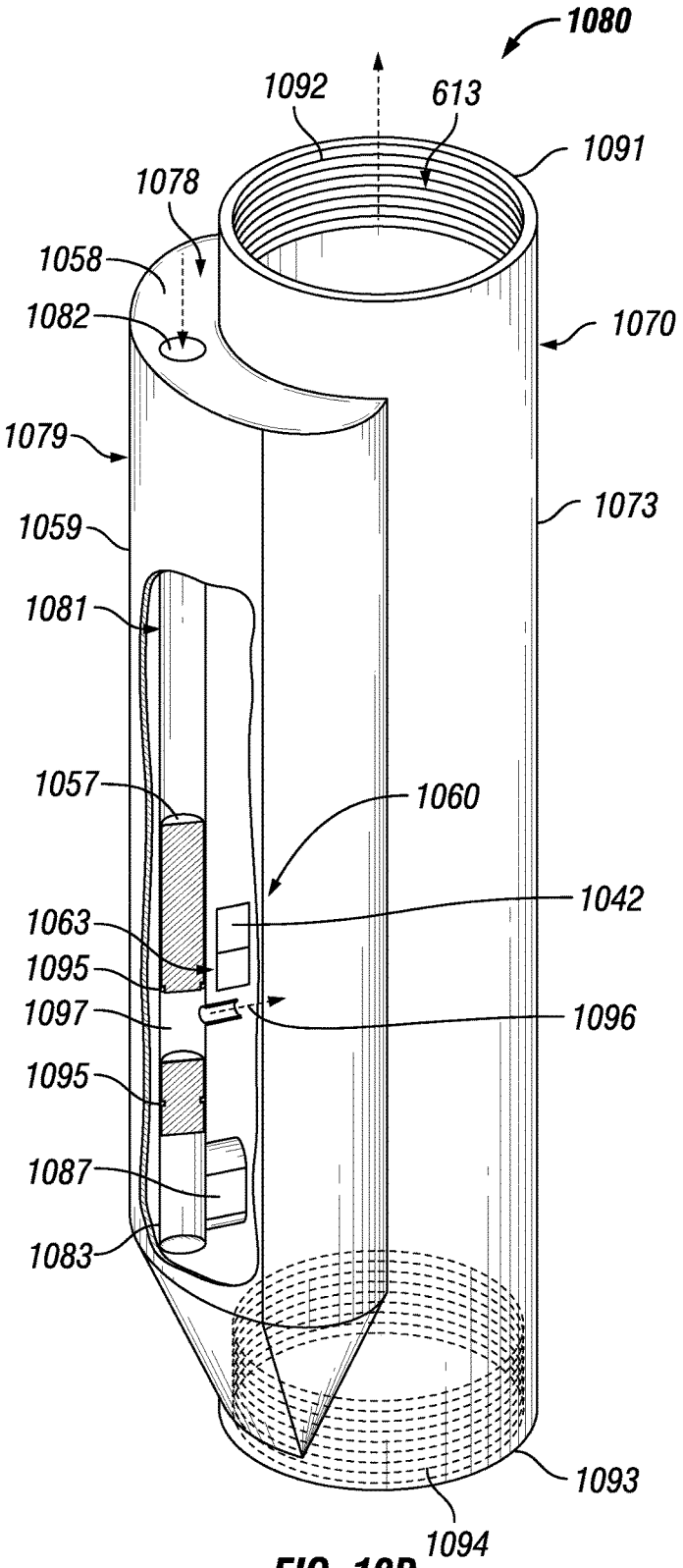

FIGS. 10A-10C show a portion of a system 1000 that includes a gas lift valve assembly 1080, which includes a mandrel 1070 (a type of remote device sleeve, also called a body 1070), in accordance with certain example embodiments. Specifically, FIG. 10A shows a cross-sectional side perspective view of the portion of the system 1000. FIG. 10B shows a semi-transparent top-side perspective view of the gas lift valve assembly 1080. FIG. 10C shows a detail from FIG. 10A. Referring to FIGS. 1-10C, the portion of the system 1000 of FIG. 10A includes two tubing pipes 615 and the gas lift valve assembly 1080 disposed between and coupled to the two tubing pipes 615.

FIG. 10B shows coupling features 1092 disposed toward the top end 1091 of the gas lift valve assembly 1080 and coupling features 1094 disposed toward the bottom end 1093 of the gas lift valve assembly 1080. In this case, the coupling features 1092, 1094 are mating threads disposed on the inner surface of the wall 1073 that forms part of the body 1070. Alternatively, the coupling features 1092, 1094 can be disposed on the outer surface of the wall 1073 and/or the coupling features 1092, 1094 can be something other than mating threads.

The body 1070 of the gas lift valve assembly 1080 can include multiple portions. For example, as shown in FIGS. 10A-10C, the body 1070 can include at least one wall 1073 and an extension 1079 that extends outward from a portion of the wall 1073. The wall 1073 can form a continuation of the cavity 613 that traverses the length of the gas lift valve assembly 1080, where the cross-sectional shape (e.g., circular) and size (e.g., diameter) of the cavity 613 is substantially the same as the cross-sectional shape and size of the cavity 613 formed by tubing pipe 615, to which the gas lift valve assembly 1080 is coupled. In certain example embodiments, the wall 1073 is electrically conductive, so that the power 749 flowing down the tubing string 614 (e.g., tubing pipes 615) also flows through the gas lift valve assemblies (in this case, gas lift valve assembly 1080).

The extension 1079 of the body 1070 can have one or more of a number of components and/or configurations. For example, as shown in FIGS. 10A-10C, the extension 1079 can include an extension wall 1059 that forms a chamber 1078 inside of which can be disposed an inlet channel 1081, a valve 1097, an outlet channel 1096, a controller 1063, an optional sensor devices 1042, and a retrieval port 1087. The retrieval port 1087 can be used to maintain a pressure gradient from the cavity 613 of the tubing string (including the cavity 613 of the gas lift valve assembly) to the annular space 123.

When multiple gas lift valve assemblies 1070 are used (as contemplated in FIG. 8), the gas lift valve assembly that is located closest to the surface 102 opens its valve so that the control medium 1057 (typically a gas) flows from the annular space 123 into the cavity 613 of the tubing string 614 and mixes with a subterranean resource in the cavity 613 between that first gas lift valve assembly 1070 and the surface 102. Once the control medium 1057 is sufficiently mixed with the subterranean resource, drawing the subterranean resource toward the surface 102, the next (second) gas lift valve assembly 1070 in the wellbore 120 is called on to perform the same function.

In that case, the first gas lift valve assembly 1070 should remain closed so that the control medium 1057, under pressure within the annular space 123, can more effectively reach the second gas lift valve assembly 1070, flow into the cavity 613, and mix with the subterranean resource between the second gas lift valve assembly 1070 and the first gas lift valve assembly 1070. This control of the second gas lift valve assembly 1070 and the first gas lift valve assembly 1070 can be achieved using the stripline cable 750, which can send addressable signals (e.g., directional traveling waves).

In some cases, in order to keep the first gas lift valve assembly 1080 closed, the valve 1097 in the first gas lift valve assembly 1080 is removed and replaced with a "dummy valve", which will not open. In other words, the dummy valve can have a similar configuration (e.g., for coupling to the gas lift valve assembly) as the valve 1097 but does not allow the control medium 1057 to flow into the cavity 613 and/or the mixture of the control medium 1057 and the subterranean resource to flow from the cavity 613 into the annular space 123. The retrieval port 1087 is used in conjunction with a wireline operation to swap between the valve 1097 and the "dummy valve", or to replace a failed valve 1097. This process is time-consuming, expensive, and can cause complications if a valve or dummy valve is dropped from the retrieval tool into the wellbore. The recovery effort, known as a "fishing job", may cause further costs to the operation and includes the risk of well abandonment should the retrieval attempt fail. Using the stripline cable 750 to control these valves 1097, there is no need to swap in a "dummy valve".

The inlet channel 1081 of the gas lift valve assembly 1080 can have one or more portions. For example, as shown in FIGS. 10A-10C, the inlet channel 1081 can have a top portion 1082 and a bottom portion 1083. The top portion 1082 can protrude through the top 1058 of the extension 1079 and be exposed to the environment in the annular space 123. During a field operation to extract subterranean resources, the annular space 123 includes a control medium 1057. The inlet channel 1081 can also protrude radially rather than axially (with a top 1082 and a bottom 1083) along the length of the gas lift valve assembly 1080.

The control medium 1057 has a density that is less than the density of a subterranean resource (e.g., oil, natural gas) disposed within the cavity 613 and which is being extracted during a field operation. By injecting the lower density control medium 1057 into the cavity 613, the control medium 1057 forces the subterranean resource toward the surface 102. The control medium 1057 can flow into the inlet channel 1081, to the valve 1097, which then controls its flow through the outlet channel 1096 into the tubing string 614.

The bottom portion 1083 of the inlet channel 1081 has the valve 1097 disposed therein. The valve 1097 can include one or more portions and have any of a number of configurations. For example, as shown in FIGS. 10A-10C, the valve 1097 slides within the inlet channel 1081 between stops 1095 that protrude inward from the surface of the inlet channel 1081. The stops 1095 limit the travel both the upward and downward travel of the valve 1097 within the inlet channel 1081. When the valve 1095 abuts against the upper stop 1095, the valve 1097 blocks the control medium 1057 from flowing into the cavity 613, and the valve 1097 also blocks the mixture of the control medium 1057 and the subterranean resource to flow from the cavity 613 into the annular space 123.

When the valve 1097 abuts against the lower stop 1095, the outlet channel 1096 becomes directly accessible to the inlet channel 1081. As a result, if the control medium 1057 has not sufficiently adjusted the pressure within the cavity 613, the control medium 1057 flows into the cavity 613, unobstructed by the valve 1097. Alternatively, if the control medium 1057 has sufficiently adjusted the pressure within the cavity 613, it is possible that the mixture of the control medium 1057 and the subterranean resource can flow from the cavity 613 into the annular space 123. With example embodiments, the movement of the valve 1097 between the stops 1095 is controlled by the controller 1063, which can be integrated with the valve 1097.

The valve 1097 can have any of a number of positions. For example, the valve 1097 can be fully closed. As another example, the valve 1097 can be fully open. As yet another example, the valve 1097 can be anywhere between fully closed and fully open. In this case, the position of the valve 1097 within the inlet channel 1081 is based on the instructions included in a first electromagnetic directional traveling wave traveling through the stripline cable 750, which passively reciprocates a second electromagnetic directional traveling wave in the second stripline cable 950. This second electromagnetic directional traveling wave is received by the remote electrical device 1060, which can include the controller 1063, one or more sensor devices 1042, a rectifier, and a receiver. The equivalent of an instrument 965 in FIG. 9 can in this case be the operating mechanism of the valve 1097.

As discussed above, the valve 1097 is moved from one position within the inlet channel 1057A to another by the controller 1063. In certain example embodiments, the controller 1063 is integrated with (part of) the valve 1097. The controller 1063 can be electrically coupled to a toroidal core transformer or some similar component that creates signals (e.g., power signals, control signals, communication signals) from the electromagnetic directional traveling waves transmitted through the stripline cable 750 and that can be used by the controller 1063. When the controller 1063 is part of the valve 1097, the valve 1097 can be coupled to the body 1070 (also called a mandrel 1070) of the gas lift valve assembly 1080 electromagnetically.

The controller 1063 receives the signals included in the second electromagnetic directional traveling waves, interprets to what extent, if any, the position of the valve 1097 should be changed, and changes the position of the valve 1097 accordingly. The controller 1063 can include one or more of a number of components, including but not limited to a hardware processor, memory, a control engine, a timer, switches, gate arrays, and an integrated circuit. In certain example embodiments, when the controller 1063 receives the signals included in the second electromagnetic directional traveling waves, the controller 1063 can also control the operation of one or more other components of the gas lift valve assembly 1080. For example, if the gas lift valve assembly 1080 includes one or more sensor devices 1042 (e.g., a gas flow sensor, a pressure sensor), the controller 1063 can operate the sensor devices 1042.

As discussed above, the purpose of a gas lift valve assembly (e.g., gas lift valve assembly 1080) is to decrease the hydrostatic pressure of fluid in the cavity 613 by injecting the control medium 1057, which has a lower density than the density of the subterranean resource within the cavity 613. As a result of the control medium 1057 being introduced into the cavity 613, the subterranean resource is raised toward the surface 102 with less energy manifested by lower pressure "loss". While the goal is to inject the control medium 1057 at the deepest possible point within the cavity 613, often times a number of gas lift valve assemblies 670 (as shown in FIG. 8) are used along the length of the tubing string 614 to more effectively start the process of lifting the subterranean resource toward the surface 102. During the start of the injection process, as the injected control medium 1057 mixes with the fluid in the annular space 123 and reaches each lower-positioned gas lift valve assembly 670B, the hydrostatic head in the wellbore 120 incrementally decreases, requiring less surface pressure to displace the next increment of fluid in the annular space 123, until the gas lift valve assembly 1080 closest to the surface 102 is reached. The valve 1097 in the higher-positioned gas lift valve assembly 1080 then closes, and the cycle is repeated until the lower-most gas lift valve assembly is reached, which then remains as the sole injection point for the control medium 1057 along the tubing string 614.

When systems having multiple gas lift valve assemblies are used in the current art, complications can arise. For example, there can be oscillating instabilities of flow and pressure within the cavity 613. These situations can lead to damaging hardware (e.g., one or more gas lift valve assemblies 1070) and/or decreasing the amount of subterranean resource that is extracted. As another example, as discussed above, during any workover or well-maintenance operation, the valve 1097 of each of the gas lift valve assemblies 1070 currently used in the art must be replaced with "dummy" valves (usually with a wireline operation) that can withstand the pressure differential between the cavity 613 of the tubing string 614 and the annular space 123 to ensure that, for example, any injected fluid within the wellbore 120 does not migrate into the annular space 123 or any other undesirable location to the specific workover operation.

This replacement procedure currently poses a number of risks to the operation, including the loss of hardware, leakage of dummy valves, or other issues that are either time consuming to resolve or may require the abandonment of the wellbore 620. Further, the valves 1097 of the gas lift valve assemblies 1070 currently used in the art are passively actuated based on the pressures within the wellbore 120 and can effectively only operate in a fully-open or closed position. Using the stripline cable 750 to deliver power and control to the gas lift valve assemblies 1070, example embodiments can provide active control of the gas lift valve assemblies 1070, which can reduce the risk of the aforementioned complications.

The method 500 of FIG. 5 can be modified by having a stripline cable (e.g., stripline cable 750) disposed along the outer surface of a tubing string 614 rather than a casing string 124, and by having the remote device sleeve (e.g., remote device sleeve 870) integrated with the tubing string 614 rather than the casing string 124. In this way, example embodiments can be used to provide power, control, and/or communication to one or more remote electrical devices 960 (e.g., gas lift valves, sensor devices) within the annulus 123 formed by the casing string 124, such as within the cavity 613 of the tubing string 614.

The systems, methods, and apparatuses described herein allow for stripline energy transmission a wellbore. Example embodiments can use power transfer coupling (also called directional coupling) to transfer energy from a central ("master") stripline cable to any of a number of discrete ("slave") stripline cables that are each dedicated to one or more electrical devices. Example embodiments can be used to broadcast energy to all electrical devices in a system, or to one or more specific electrical devices in the system.

Example embodiments allow for more efficient and directional operation of electrical devices in a subterranean wellbore. For example, example embodiments can be used to systematically and in a targeted fashion perform a fracturing operation, where one or more specific zones adjacent to the wellbore can be fractured, and results can be measured, before subsequent zones are subjected to a fracturing operation. Thus, using example embodiments can provide significant costs savings, a higher level of reliability, easier installation, and easier maintenance.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A downhole energy transmission system, comprising:

a tubing string comprising a plurality of tubing pipe disposed within an annulus formed by a casing string disposed within a wellbore, wherein the tubing string has at least one wall forming a cavity;

a first remote electrical device disposed within the cavity of the tubing string at a first location;

a first stripline cable disposed toward an outer surface of the tubing string within the wellbore, wherein the first stripline cable transmits a first electromagnetic directional traveling wave in a first direction along the first stripline cable; and a second stripline cable disposed adjacent to the first stripline cable at the first location, wherein the second stripline cable is electrically coupled to the first remote electrical device, wherein the first electromagnetic directional traveling wave transmitted through the first stripline cable passively reciprocates a second electromagnetic directional traveling wave in the second stripline cable, wherein the second electromagnetic directional traveling wave is used to operate the first remote electrical device, wherein the first stripline cable comprises a rugged outer surface that withstands scraping against the casing string as the tubing string is inserted into the annulus formed by the casing string, wherein the second electromagnetic directional traveling wave is generated without resonance, without inductive materials, and without direct physical coupling between the first stripline cable and the second stripline cable, and wherein the first electromagnetic directional traveling wave comprises an operating frequency of at least one Hertz.

2. The system of claim 1, further comprising:

a second remote electrical device disposed within the cavity of the tubing string at a second location; and a third stripline cable disposed adjacent to the first stripline cable at the second location, wherein the third stripline cable is electrically coupled to the second remote electrical device, wherein the first energy transmitted through the first stripline cable passively reciprocates a third electromagnetic directional traveling wave in the third stripline cable, wherein the third electromagnetic directional traveling wave is used to operate the second remote electrical device.

3. The system of claim 2, wherein the first electromagnetic directional traveling wave comprises a first signal and a second signal, wherein the first signal is addressed to the first remote electrical device, and wherein the second signal is addressed to the second remote electrical device.

4. The system of claim 1, wherein the first stripline cable is disposed within a channel in the outer surface of the tubing string.

5. The system of claim 4, further comprising:

at least one coupling device disposed in the channel of the tubing string, wherein the at least one coupling device secures the first stripline cable against the outer surface of the tubing string within the channel.

6. The system of claim 1, wherein the second stripline cable is disposed within a channel in a remote device sleeve at the first location.

7. The system of claim 6, further comprising:

at least one retaining device disposed in the channel of the tubing string, wherein the at least one coupling device secures the second stripline cable within the channel at the first location.

8. The system of claim 1, wherein the tubing string further comprises at least one remote device sleeve, and wherein the first remote electrical device and the second stripline cable are disposed in a first remote device sleeve of the at least one remote device sleeve.

9. The system of claim 8, wherein the first stripline cable is disposed within a channel in the at least one remote device sleeve, wherein the first stripline cable abuts against the second stripline cable within the channel.

10. The system of claim 1, further comprising:

a terminator load coupled to a distal end of the first stripline cable.

11. The system of claim 1, further comprising:

a terminator load coupled to a first end of the second stripline cable, wherein the first remote electrical device is coupled to a second end of the second stripline cable.

12. The system of claim 1, wherein the second stripline cable is electrically coupled to the first remote electrical device.

13. The system of claim 1, wherein the first remote electrical device comprises a rectifier and a receiver.

14. The system of claim 1, wherein the first stripline cable and the second stripline cable form a power transfer coupling mechanism.

15. The system of claim 1, wherein the second stripline cable ignores a second directional traveling wave traveling through the first stripline cable in a second direction, wherein the second direction is opposite the first direction.

16. The system of claim 1, wherein the first stripline cable comprises a first electrically conductive element disposed between first layers of electrically non-conductive material.

17. The system of claim 16, wherein the first layers of electrically non-conductive material comprise a material that withstands scraping against the casing string when the tubing string is inserted into the annulus of the casing string.

18. The system of claim 1, wherein the first remote electrical device comprises a controller for a gas lift valve.

19. A method for providing energy in a wellbore of a subterranean formation, the method comprising:

transmitting a first electromagnetic directional traveling wave through a first stripline cable, wherein the first stripline cable is disposed toward an outer surface of a tubing string within the wellbore;

generating a second electromagnetic directional traveling wave in a second stripline cable using directional traveling wave coupling between the first stripline cable and the second stripline cable, wherein the second stripline cable is disposed within the tubing string at a first location; and delivering, using the second stripline cable, the second electromagnetic directional traveling wave to a first remote electrical device, wherein the second electromagnetic directional traveling wave is used to operate the first remote electrical device at the first location, wherein the first stripline cable comprises a rugged outer surface that withstands scraping against the casing string as the tubing string is inserted into the annulus formed by the casing string, wherein the second electromagnetic directional traveling wave is generated without resonance, without inductive materials, and without direct physical coupling between the first stripline cable and the second stripline cable, and wherein the first electromagnetic directional traveling wave comprises an operating frequency of at least one Hertz.

20. The method of claim 19, further comprising:

generating a third electromagnetic directional traveling wave in a third stripline cable using the directional traveling wave coupling between the first stripline cable and the third stripline cable, wherein the third stripline cable is disposed within the tubing string at a second location; and delivering, using the third stripline cable, the third electromagnetic directional traveling wave to a second remote electrical device, wherein the second electromagnetic directional traveling wave is used to operate the second remote electrical device at the second location.

* * * * *